United States Patent [19]

Tomaszewski

[11] 4,264,420

[45] Apr. 28, 1981

[54] ELECTROLYTIC STRIPPING BATH AND PROCESS

[75] Inventor: Lillie C. Tomaszewski, Dearborn, Mich.

[73] Assignee: Oxy Metal Industries Corporation, Warren, Mich.

[21] Appl. No.: 166,215

[22] Filed: Jul. 7, 1980

Related U.S. Application Data

[63] Continuation-in-part of Ser. No. 89,059, Oct. 29, 1979, Pat. No. 4,233,124.

[51] Int. Cl.[3] ..... C25F 3/02; C25F 5/00

[52] U.S. Cl. ..... 204/146; 204/129.95

[58] Field of Search ..... 204/129.85, 129.95, 204/146

[56] References Cited

U.S. PATENT DOCUMENTS

| | | | |
|---|---|---|---|
| 3,492,210 | 1/1970 | Bowers | 204/146 |
| 3,617,456 | 11/1971 | Dillenberg | 204/146 |
| 3,619,390 | 11/1971 | Dillenberg | 204/146 |
| 3,649,489 | 3/1972 | Dillenberg | 204/146 |
| 3,793,172 | 2/1974 | Cadieux | 204/146 |
| 3,912,603 | 10/1975 | Mietens | 204/146 |

*Primary Examiner*—T. M. Tufariello

*Attorney, Agent, or Firm*—Richard P. Mueller

[57] ABSTRACT

An improved electrolytic bath composition and process for stripping metal deposits from a different basis metal comprising an aqueous solution containing activating halogen compounds, an amine, nitro and/or nitrate stripping component, an inhibiting agent to inhibit attack of the basis metal comprising glucoheptonic acid, malic acid, and mixtures thereof, as well as the Group IA, IIA and ammonium salts thereof, and at least one bath soluble compound selected from the group consisting of thiocyanates, oxalates, and mixtures thereof. The stripping of the metal deposit is effected by immersion of the object in the bath while anodically charged and passing electric current through the bath to a cathode for a period of time suffient to achieve the desired magnitude of stripping of the metal deposit.

32 Claims, No Drawings

ELECTROLYTIC STRIPPING BATH AND PROCESS

REFERENCE TO RELATED APPLICATIONS

The present application is a continuation-in-part of prior copending application Ser. No. 89,059 filed Oct. 29, 1979, now U.S. Pat. No. 4,233,124.

BACKGROUND OF THE INVENTION

The present invention is broadly applicable to a solution and method for electrolytically stripping or removing unwanted metallic deposits or platings from substrates, and more particularly, for stipping unwanted metal plating deposits from electroplating apparatus such as the contact tips of work racks as well as for removing defective or damaged metallic platings from ferrous substrates such as steel in order to enable the stripped articles to be replated without incurring any etching or damage to the steel substrate.

In the art of electroplating, it is conventional practice to support work pieces to be plated on a work rack which is comprised of a chemically resistant metal such as titanium or stainless steel or a conventional steel work rack having a protective coating thereover such as a polyvinyl chloride plastisol coating. The electrification of the work pieces while suspended in a suitable electrolyte is achieved by stainless steel or platinumized titanium contact tips on the rack which are connected in electrical contact with the work pieces. During an electroplating operation, an unwanted metal deposit builds up on the contact tips of the work rack which interferes with the efficiency and consistency of the electroplating operation. It is common practice, accordingly, to subject such work racks to mechanical or chemical cleaning treatments in order to periodically remove the unwanted metal deposit accumulation in order to maintain optimum operating efficiency thereof.

The stripping or removal of certain metal deposits is also occasionally required from articles which have been electroplated but wherein the resultant electrodeposit or electroless metal deposit is defective or has become mechanically damaged during handling in order to salvage the article and enable a reprocessing thereof. The stripping or removal of the metal deposit from the surfaces of such articles must be performed in a manner which does not materially etch or damage the underlying substrate to a degree which prevents replating thereof and without requiring substantial polishing and/or buffing operations to restore the substrate surface to a condition in which it can be replated.

In the case of stripping metal deposits from electroplating apparatus such as the contact tips of work racks, it is important that the stripping solution and conditions employed do not materially effect an attack of the contact tips themselves causing a progressive errosion of such contact tips thereby reducing the efficiency of the electroplating operation and necessitating frequent reworking and replacement of such contact tips.

A variety of chemical and electrolytic stripping processes and solutions have heretofore been used or proposed for use for removing unwanted metal deposits of various types from substrates including plated articles as well as contact tips of electroplating apparatuses. Typical of such prior art practices and compositions are those disclosed in U.S. Pat. Nos. 3,492,210; 3,617,456; 3,619,390; 3,649,489; 3,793,172; and 3,912,603. A continuing problem associated with prior art electrolytic stripping formulations and processes has been their inability to effectively strip a wide variety of different metal deposits necessitating separate solutions and processes for the several types of metal deposits to be removed; the relatively slow stripping rate of certain prior art techniques in removing unwanted metal deposits, and the tendency of certain prior art stripping formulations and processes to attack and damage the basis metal during the course of the stripping of the metal deposit therefrom.

The present invention provides for an electrolytic stripping bath and process which is adaptable for rapidly and efficiently stripping a wide variety of metal deposits from a basis metal of different composition and which is inhibited so as to significantly reduce the attack and etching of the basis metal during the stripping operation.

SUMMARY OF THE INVENTION

The benefits and advantages of the present invention are achieved in accordance with the composition aspects thereof, by an aqueous stripping bath comprising an aqueous solution containing activating halogen compounds, a bath soluble amine, nitrate and/or nitro stripping component, hydrogen ions to provide a pH of from about 1 up to about 14, preferably a carboxylic acid buffering agent present in an amount up to about 60 grams per liter (g/l) an inhibitor to inhibit attack of the basis metal comprising glucoheptonic acid, malic acid and mixtures thereof, as well as the Group IA, IIA and ammonium salts thereof in which the glucoheptonic acid and/or salts thereof are present in an amount of about 1 g/l up to saturation in the bath with amounts of about 5 up to about 20 g/l being usually preferred and the malic acid and/or salts thereof are present in an amount of 1 g/l up to about 20 g/l when used alone and in amounts up to 40 g/l when employed in admixture with the glucoheptonic acid or salts. In accordance with the present invention, the aqueous stripping bath further contains a controlled amount of a bath soluble thiocyanate compound as a supplemental activator for effecting the stripping of nickel-iron alloys and sulfur-free nickel deposits from areas of a basis metal subjected to relatively low current densities during the stripping operation. The bath further contains, a bath soluble oxalate compound, alone or in combination with the thiocyanate compound, as a supplemental inhibitor to prevent etching of the basis metal, particularly after current interruptions during the stripping process and also as a supplemental activator for increasing the stripping rate of the metal plating.

In the amine-type stripping bath, a controlled effective amount usually ranging from about 30 to about 200 g/l of a primary, secondary and/or tertiary alkyl or alkanol amine containing from $C_1$ to $C_8$ carbons is employed in combination with nitric acid to provide the requisite pH of the stripping bath. In the so-called amine-free type stripping formulation, aqueous soluble organic nitro and/or inorganic nitrates are employed in lieu of the amine and pH adjustment of the operating bath can be effected by nitric acid, acetic acid or the like, as well as alkali metal hydroxides including ammonium hydroxide. It is also contemplated that mixed baths containing both the amine and the organic nitro and/or inorganic nitrate stripping components can be employed. The halogen activating compounds preferably comprise bromine containing compounds which liberate bromine ions to accelerate the stripping action. The glucoheptonic acid inhibiting agent is preferably introduced in the form of an alkali metal salt such as sodium glucoheptonate, for example. The thiocyanate compound is preferably introduced in the bath as ammonium thiocyanate at a concentration of about 0.1 to about 20 g/l, preferably about 1 to about 5 g/l. The oxalate compound is preferably introduced into the bath as ammonium oxalate and can be present in an amount of about 0.5 g/l up to its solubility with concentrations of from about 1 to about 4 being preferred.

In accordance with the process aspects of the present invention, the stripping of unwanted metal deposits such as copper, bright and semi-bright nickel, sulfamate nickel, nickel phosphorus, cadmium, brass, tin, chromium, and alloys such as iron-nickel alloys is effected by immersing an object with the metal deposit thereon in the aqueous stripping solution with the object anodically charged and passing electric current through the bath between a cathode and the object for a period of time sufficient to effect the desired magnitude of stripping of the metal deposit. The aqueous stripping solution can be operated at room temperature (60° F.) up to about 150° F. with temperatures of about 70 tc about 100° F. being preferred for stripping deposits from a mild steel basis metal. The current density during the stripping operation will vary depending upon the resistivity of the basis metal to attack by the stripping solution. In connection with electroplating apparatus such as the contact tips of work racks, for example, which are comprised of a resistant stainless steel alloy such as a type 304 stainless steel or better, current densities of about 100 to about 1500 amperes per square foot (ASF) can be employed, whereas for stripping metal deposits from conventional steel substrates, lower current densities of about 10 to about 200 ASF can satisfactorily be employed.

An inclusion of a controlled effective amount of the inhibiting agent or mixtures of inhibiting agents significantly reduces the corrosion or etching of the basis metal during the stripping process and, surprisingly, has been found to also serve as an activator for stripping iron-nickel alloy deposits which are not effectively stripped employing the same stripping formulation devoid of the inhibiting agent.

Additional benefits and advantages of the present invention will become apparent upon a reading of the description of the preferred embodiments taken in conjunction with the specific examples provided.

DESCRIPTION OF THE PREFERRED EMBODIMENTS

The stripping bath of the present invention is primarily adapted but not necessarily limited to the stripping of sulfur-free nickel and nickel-iron deposits from parts comprised of a relatively non-resistant basis metal such as mild or low alloy steel as well as hardened steel. In such part-stripping operations to remove defective electrodeposits to enable a replating of the part, it is common practice to place such parts on a work rack during the electrolytic stripping operation. In the case of automobile bumpers, for example, it is not unusual to rack 4 to 8 bumper parts on a work rack to effect a simultaneous stripping thereof. Because of the large surface area of such parts as well as their complex configuration, it has been found that certain areas of certain of the parts being stripped are subjected to relatively low current densities as low as 10 ASF whereby a relatively slow stripping of metal deposits in such low current density areas occurs. Additionally, the plate deposit on such parts varies considerably in thickness over its surface area and the chemical composition of such plating deposits also varies resulting in differences in stripping rates.

It is also common practice in such part-stripping operations, to periodically withdraw the work rack from the stripping bath to inspect the parts and to remove those which have been satisfactorily stripped while returning those which require further stripping to the stripping bath. Such interruption in the current during the stripping operation has been observed to result in excessive etching of the metal substrate during subsequent stripping cycles particularly in the fatigued or stress areas of mild steel base metals. According to the present invention, it has now been found that the inclusion of a controlled amount of a bath soluble thiocyanate in the stripping bath serves as a supplemental activator for effecting the stripping of nickel-iron alloys and sulfur-free nickel deposits from areas of the basis metal which are subjected to only relatively low current densities achieving thereby uniform and efficient stripping of the metal deposits. Additionally, it has been discovered that the inclusion of a bath soluble oxalate compound serves as a supplemental inhibitor to prevent etching of the basis metal following a current interruption in the stripping process and also serves as a supplemental activator for increasing the stripping rate of the various metal platings. While the bath and process of the present invention are particularly applicable for part-stripping of metal deposits from non-resistant basis metals, it will be appreciated that the bath can also be employed for stripping metal deposits from resistant basis metals including the contact tips of work racks and stainless steels although the inclusion of the bath soluble thiocyanate and oxalate compounds is ordinarily not necessary under such circumstances.

The unexpected effect of the stripping bath and process of the present invention has been observed and demonstrated in both so-called amine type as well as so-called amine free type stripping baths. Both of these type electrolytic stripping baths comprise aqueous solutions which can operate at a pH range of about 1 up to about 14 and preferably at a pH of about 5.5 to about 7.5. Generally, the lower the pH, the more rapid is the stripping of the metal deposit. A pH as low as about 1 is commercially impractical because of the difficulty in maintaining such a low pH during bath operation. On the other hand, a pH as high as about 14 is also commercially impractical because of the unacceptable low stripping rate. In accordance with a preferred commercial practice, the stripping bath is maintained at an operating pH of from about 5.5 to about 7.5 when stripping metal deposits from objects composed of a relatively non-resistant ferrous basis metal such as steel, for example. When stripping metal deposits from articles composed of a relatively resistant basis metal, such as stainless steel, for example, a pH range of about 6.5 to about 7.5 is preferred from a commercial standpoint.

Both amine and amine-free type of bath preferably, but not necessarily, contain a buffering agent in an amount usually up to about 60 g/l, preferably 20 to 40 g/l, comprising a carboxylic acid of which acetic acid or alkali metal and ammonium salts thereof constitute the preferred buffering agent. Other suitable carboxylic acid buffering agents include isoascorbic acid, citric acid, succinic acid and the like. While Oxalic acid can be employed in some instances, its use is generally undesirable since when stripping nickel platings, nickel oxalate is formed which is substantially insoluble and tends to form sludge in the operating bath. Lactic acid, on the other hand, is usually undesirable due to its tendency to decompose while tartaric acid is undesirable due to its tendency to form sludge. Of the foregoing carboxylic acid buffering agents, acetic acid constitutes the preferred material and can conveniently be introduced as glacial acetic acid.

Both the amine and amine-free type stripping bath contain halogen compounds in controlled amounts to activate the bath and accelerate the stripping of the metal deposits from the basis metal. While the fluorine and chlorine containing compounds can be employed to some extent, these halogen materials are too active in some instances and are less desirable than bromine compound activators which possess the requisite activity range for most metal deposits and basis metals. Iodine compounds can also be satisfactorily employed but are less desirable due to their lower activity necessitating the use of higher concentrations than those required employing bromine compounds. The halogen containing activator compounds are selected from organic and inorganic compounds which are soluble in the bath; the halide activator compound, such as the preferred bromine compound may be in the form of the bromide, hypobromite and/or bromate in which the compound on dissolution liberates the corresponding halide rendering it available for activation. The quantity of halide compound employed can be varied depending upon the specific halide used and the type of metal deposit to be stripped in addition to the specific conditions employed during the stripping process and the types and quantities of other constituents present in the stripping bath. Ordinarily, the halide activator compound can be present in amounts up to about 40 g/l calculated as sodium bromide equivalent with amounts of about 8 to about 15 g/l being preferred. When the stripping bath contains the oxalate compound and is employed for stripping plate deposits from a non-resistant basis metal such as steel, it is preferred practice to control the halide activator compound at a maximum concentration of 20 g/l calculated as a weight equivalent to sodium bromide. When the stripping bath contains the thiocyanate compound and is employed for stripping plate deposits from a mild steel or other non-resistant basis metal, the halide activator compound should be controlled at a concentration of less than about 12 g/l, and preferably within a range of about 6 to about 10 g/l to avoid undesirable etching of the substrate when such etching cannot be tolerated. When stripping copper metal deposits, no halogen activator or only relatively small amounts are required. However, when stripping metal deposits such as nickel and nickel-iron alloys, for example, the use of a halogen activator compound is necessary to attain satisfactory stripping rates.

In the amine-type stripping bath, in addition to the buffering agent and halogen activating agent, the stripping formulation further contains as a stripping component, an effective amount of an aqueous soluble primary, secondary, tertiary amine or mixtures thereof having a carbon content ranging from about $C_1$ up to about $C_8$ depending on whether the amine is of the primary, secondary or tertiary type. The concentration of the amine in the bath is controlled within conventional prior art practices and typically can range from about 30 to about 200 g/l with the specific concentration established by the type of metal deposit being stripped to attain optimum stripping action. Alkanol amines are particularly preferred because of their solubility in the bath. Typical of the amines that can be satisfactorily employed are those listed in Table 1.

TABLE 1

Ethylene Diamine
Triethanolamine
Isopropanolamine
Monoethanolamine
Butylamine
Hexylamine
Diamylamine
Diethanolamine
Dimethanolamine
Triethylamine
Tripropylamine It will be appreciated that the amine-type stripping bath may also contain variable amounts of organic nitro and/or inorganic nitrate compounds of the same types employed in amine-free baths. When using such a mixture of stripping components, the concentration of the amine stripping component can be correspondingly decreased in consideration of the quantity of the nitrate/nitro compound present to maintain the desired stripping action.

The amine-type stripping bath further contains nitric acid present in an amount to adjust the pH of the electrolytic stripping bath within a range of about 1 to about 14. The presence of the amine in the bath normally provides a pH of about 9 to about 10 and sufficient nitric acid is incorporated to reduce the pH to within the aforementioned range and preferably within a range of about 5.5 to about 7.5 in consideration of any carboxylic acid buffering agent which may also be present.

The amine-free stripping bath contains, in addition to the optional buffering agent and halogen activator compound, a controlled effective amount of bath soluble organic nitro and/or organic nitrate compounds sufficient to attain the desired stripping action. The specific concentration employed will vary depending upon the type of metal deposit to be stripped as well as the resistance of the basis metal to chemical attack. Inorganic nitrate compounds which can satisfactorily be employed comprise the alkali metal and/or ammonium nitrate compounds along with nitric acid itself to adjust the bath within the required pH range. Aqueous soluble organic nitro compounds that can be satisfactorily employed are typically set forth in Table 2.

TABLE 2

Nitrobenzoic Acid
4-Nitroisophthalic Acid
Sodium Nitrobenzoate
Sodium Meta-Nitrobenzene Sulfonate For the electrolytic stripping of metal deposits from relatively resistant basis metals, such as, for example, type 304 or type 316 stainless steels, the concentration of the nitrate and/or nitro compound can usually range from about 10 up to about 250 g/l calculated as ammonium nitrate or equivalent, with concentrations of about 30 to about 50 g/l being preferred. In electrolytic stripping baths employed for stripping metal deposits such as bright nickel, electroless nickel-phosphorous and copper from conventional steel basis metals, the concentration of the nitrate and/or nitro compound can broadly range from about 80 g/l to about 480 g/l calculated as ammonium nitrate.

In addition to the foregoing constituents, the amine and amine-free electrolytic stripping baths contain as an essential constituent an inhibitor agent for inhibiting attack of the basis metal during the electrostripping process comprising glucoheptonic acid, malic acid and mixtures thereof as well as the Group IA, IIA and/or ammonium salts thereof. The glucoheptonic acid and/or glucoheptonate salt inhibiting agent can be present in an amount of as low as about 1 g/l up to saturation in the stripping bath. Preferably, the glucoheptonic acid and/or glucoheptonate salt inhibiting agent is employed in amounts of about 5 to about 25 g/l. Amounts above about 25 g/l normally do not provide any appreciable benefits over that achieved employing concentrations of about 25 g/l.

Alternatively, the inhibitor agent comprises malic acid as well as the Group IA, IIA and/or ammonium salts thereof which is employed in amounts of about 1 g/l up to about 20 g/l. When the malic-type inhibiting agent is employed as the sole inhibiting agent, concentrations above about 20 g/l have been observed to cause undesirable etching of the basis metal in some instances. In accordance with a preferred practice, the glucoheptonic-type and malic-type inhibitor agents are employed in combination because of an apparent synergistic behavior of such combination on the inhibition of etching of the basis metal in comparison to that obtained by the use of either of these two agents individually. Particularly satisfactory results have been obtained when the weight ratio of the gluco-heptonic-type agent to malic-type agent ranges from about 1:1 up to about 5:1. When the malic-type inhibitor is employed in combination with the glucoheptonic-type inhibitor, the malic-type inhibitor can be employed in concentrations as high as about 40 g/l.

In the make-up of the electrolytic stripping bath, the halogen activator compound can be conveniently introduced into the bath in the form of a compound of the type and class as set forh in Table 3.

TABLE 3

2-Chloro-5-Nitrosulfonic Acid
N-Chloromethyl Triethyl Ammonium Bromide
Pyridine Allylbromide
2-2', 3-3' Tetrachlorosuccinaldehyde
2-5 Dibromopyridine
Ortho-Chlorophenol
Guanadine Hydrochloride
NaBr
$NaBrO_3$
NaBrO In accordance with the further improvement of the present invention, the stripping bath additionally contains a bath soluble thiocyanate compound as a supplemental activator for effectively stripping nickel-iron and sulfur-free nickel deposits from low current density areas of a part being stripped. The thiocyanate compound can be introduced in the bath as any bath soluble compatible salt such as an alkali metal or ammonium salt of which the latter is preferred. While concentrations as low as 0.1 g/l of the thiocyanate compound calculated as an equivalent to ammonium thiocyanate evidences an increased stripping activity in low current density areas, such low concentrations are commercially impractical and amounts of at least about 0.5 g/l are usually employed. On the other hand, concentrations above about 20 g/l are undesirable because they tend to cause the formation of a smutty insulating film or layer on plate surface inhibiting effective stripping thereof. Usually, amounts of the thiocyanate compound ranging from about 1 to about 5 g/l is satisfactory for most commercial part stripping operations with a concentration of about 1 to about 2.5 g/l being ideal.

It has also been discovered that a portion of the thiocyanate compound can be substituted with a bath soluble compatible cyanate compound achieving an equivalent stripping activation because of an apparent syngergism therebetween. Preferably, the cyanate compound comprises any of the alkali metal and ammonium salts of which sodium cyanate is the preferred material. When employing a combination of the thiocyanate and cyanate compounds, the thiocyanate should be present in an amount of at least 0.1 g/l with amounts of about 0.2 to about 1 g/l being preferred. The cyanate compound calculated on an equivalent of sodium cyanate can be present up to about 20 g/l, with amounts of about 1 to about 5 g/l being preferred. A particularly satisfactory combination is about 0.8 g/l ammonium thiocyanate and about 2 g/l of sodium cyanate.

In accordance with still another improvement of the present invention, the stripping bath contains a bath soluble oxalate compound which serves as a supplemental inhibitor to prevent etching of non-resistant basis metals such as steel as a result of interruption of current during a part stripping operation. The oxalate compound has also been found to serve as a supplemental activator facilitating the stripping efficiency of the bath with respect to all metal plate deposits. The oxalate compound can be introduced into the bath as oxalic acid as well as the alkali metal and ammonium salts thereof of which ammonium oxalate constitutes the preferred material. The concentration of the oxalate compound may range up to the solubility in the bath to amounts as low as about 0.5 g/l calculated as ammonium oxalate. Because of the tendency of the oxalate compound to form sludge in the bath due to the formation of bath insoluble nickel oxalate compounds, it is preferred to control the concentration at low levels within the permissible range with concentrations of about 1 to about 4 g/l being particularly satisfactory. When the oxalate compound is present in the bath without any thiocyanate compound present, it is preferred to control the halide activator compound within a range of about 8 to about 15 g/l calculated as sodium bromide.

In accordance with the process aspects of the present invention, the amine and amine-free electrolytic stripping bath can be satisfactorily operated at a temperature of about room temperature (60° F.) up to about 150° F. with temperatures of about 120° to about 140° F. being usually preferred. When employing a bath containing the thiocyanate compound for stripping plate deposits from a non-resistant basis metal such as mild steel, for example, the increase activity of the bath dictates the use of lower bath temperatures preferably ranging from about 70° to about 110° F. to avoid undesirable etching of the substrate. When stripping metal deposits from relatively resistant basis metals, such as a type 301 stainless steel alloy, for example, current densities of from about 100 up to about 1500 ASF can be employed at voltages generally ranging from about 3 up to about 15 volts. Preferably, when stripping the contact tips of work racks for example, comprised of at least a type 304 stainless steel or platinumized titanium basis metal, current densities of about 500 ASF at a voltage of about 5 is preferred. On the other hand, when stripping defective metal deposits from relatively low resistant substrates such as conventional steel, for example, current densities of about 25 up to about 200 ASF can be employed at voltages usually ranging from about 3 up to about 10 volts.

When stripping metal deposits from resistant basis metals, the electrolytic stripping bath of the present invention can satisfactorily be employed for stripping copper, bright and semi-bright nickel, sulfamate nickel, nickel-phosphorous, cadmium, brass, tin, chromium, and iron-nickel alloys. Bright nickel, electroless nickel-phosphorous and copper metal deposits can also be effectively stripped from conventional steel basis metal without adversely corroding or etching the basis metal employing the electrolytic stripping bath of the present invention.

The stripping process is accomplished by immersing the object to be stripped in the electrolytic stripping solution and connecting the object to the anode and passing current through the stripping bath between the object and cathode at the desired current density for a period of time sufficient to effect the desired magnitude of stripping of the metal deposit.

In order to further illustrate the composition and process of the present invention, the following examples are provided. It will be understood that the examples are provided for illustrative purposes and are not intended to be limiting of the scope of the present invention as herein described and as set forth in the subjoined claims.

EXAMPLE 1

An electrolytic stripping bath suitable for stripping nickel-iron alloy deposits from a mild steel basis metal is formulated containing 240 g/l ammonium nitrate, 10 g/l sodium glucoheptonate, 10 g/l malic acid, 6 g/l sodium bromide and 1 g/l ammonium thiocyanate. The bath has a pH of 5.5 and is operated at a temperature of about 80° F. The stripping bath is employed for stripping a nickel-iron plating deposit containing about 25% iron from a mild steel test coupon at average current densities of 10, 50, 100, 125, 150, and 200 ASF. The nickel-iron alloy plate is effectively stripped at each operating current density level.

At a current density of about 100 ASF, the stripping rate of the nickel-iron alloy deposit is about 2 microns per minute without bath agitation and at a rate of about 2.5 microns per minute employing air agitation.

EXAMPLE 2

An electrolytic stripping bath is formulated suitable for stripping duplex platings comprising a bright sulfur-containing nickel plating overlying a semi-bright sulfur-free nickel deposit on a mild steel basis metal. Such duplex platings are usually characterized by a stripping action in which the outer bright sulfur-containing nickel plate comes off quickly but as the sulfur-free nickel plate is exposed, passivation occurs and uniformity in the further stripping action on the underlying plate cannot be obtained in the absence of the use of the ammonium thiocyanate additive.

Effective stripping of such a duplex plate deposit is achieved by formulating a stripping bath containing 240 g/l ammonium nitrate, 10 g/l sodium glucoheptonate, 10 g/l malic acid, 8 g/l sodium bromide and 2 g/l ammonium thiocyanate. The bath has a pH of 5.5 and a temperature of about 80° F. The bath effectively strips the duplex nickel plate at specific average current densities of 10, 50, 100, 125, 150 and 200 ASF. At a specific current density of 100 ASF, the stripping rate of the bath under the foregoing conditions is about 2 microns per minute without agitation and about 2.5 microns per minute in the presence of air agitation.

EXAMPLE 3

An electrolytic stripping bath is formulated suitable for stripping semi-bright sulfur-free nickel deposits and nickel-iron alloy deposits containing about 25% iron. The stripping bath contains 240 g/l ammonium nitrate, 10 g/l sodium glucoheptonate, 10 g/l malic acid, 8 g/l sodium bromide, 0.4 g/l ammonium thiocyanate and 2 g/l sodium cyanate as a partial substitute for the thiocyanate. The bath is operated at a current density of 100 ASF at a temperature of 80° F. and pH of about 5.5.

Mild steel test coupons having a bright sulfur containing nickel plate thereon under the foregoing operating and composition conditions are removed at a stripping rate of about 3 microns per minute in the absence of agitation and about 3.5 microns per minute with air agitation. Similarly, nickel-iron alloy plates and semi-bright sulfur-free nickel deposits are removed at a rate of about 2 microns per minute without agitation and a rate of about 2.5 microns per minute with air agitation.

EXAMPLE 4

An electrolytic stripping bath is formulated suitable for stripping sulfur-free semi-bright nickel deposits and nickel-iron alloy deposits containing 240 g/l ammonium nitrate, 10 g/l sodium glucoheptonate, 10 g/l malic acid, 6 g/l sodium bromide, 2 g/l ammonium thiocyanate, and 1 g/l ammonium oxalate. The bath is operated at a pH of about 6, a temperature of about 80° F. and a current density of about 100 ASF.

Polished mild steel test coupons having a sulfur-free semi-bright nickel plate on the one hand, and a nickel-iron alloy plate on the other hand, containing about 25% iron are stripped at a rate of about 2.5 microns per minute in the absence of agitation and at a rate of about 3 microns per minute with air agitation at 100 ASF current density.

In order to determine the inhibiting effect of the oxalate compound on the basis metal following a current interruption in the stripping cycle, the resultant stripped panels are removed from the stripping solution, wiped dry, weighed and thereafter immersed in the stripping bath maintained at the same temperature and pH. A voltage of 3 is applied to the stripped test coupon for a period of about 30 minutes. The bath of Example 4 incorporating the oxalate compound resulted in a substantially zero loss of the mild steel test coupon whereas the same bath devoid of the oxalate compound resulted in a loss of 19 milligrams (mg) over the 30 minute period on a test coupon having a total surface area of 7.5 square inches. This represents a loss of basis metal of about 0.004% weight.

EXAMPLE 5

The further activation provided by the addition of an oxalate compound as a supplemental activator in the stripping rate of sulfur-containing nickel deposits on a mild steel test coupon is demonstrated by this example. An electrolytic stripping bath is prepared containing 240 g/l ammonium nitrate, 6 g/l sodium bromide, 10 g/l sodium glucoheptonate, 10 g/l malic acid and 1 g/l ammonium oxalate. The bath is operated at a temperature of 80° F., a pH of about 6 and an average current density of about 100 ASF. Under these conditions, the stripping rate of the sulfur-containing nickel deposit is about 3 microns without agitation and about 3.5 microns with air agitation. The resultant stripped panels were subjected to a further immersion in the stripping solution in accordance with the procedure as previously described in Example 4 to determine the attack of the mild steel basis metal. Substantially no less in weight of the test coupon was observed over a period of 30 minutes at a voltage of about 3 in the stripping solution further evidencing the inhibiting effect of the oxalate compound on the basis metal attack.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An electrolytic stripping bath for stripping metal deposits from a different basis metal comprising an aqueous solution having a pH of about 1 to about 14 and containing a halogen compound in an amount sufficient to activate the bath, a stripping component selected from the group consisting of (a) a bath soluble primary, secondary and/or tertiary amine having a carbon content of $C_1$ to $C_8$, (b) a bath soluble inorganic nitrate and/or organic nitro compound and mixtures of (a) and (b), an inhibiting agent present in an effective amount to inhibit attack of the basis metal comprising a compound selected from the group consisting of glucoheptonic acid, malic acid, and mixtures thereof as well as the Group IA, IIA and ammonium salts thereof and at least one bath soluble compound selected from the group consisting of thiocyanates, oxalates and mixtures thereof.

2. The stripping bath as defined in claim 1 in which the thiocyanate said bath soluble compound includes the alkali metal and ammonium salts thereof.

3. The stripping bath as defined in claim 1 in which the thiocyanate said bath soluble compound comprises ammonium thiocyanate.

4. The stripping bath as defined in claim 2 in which the thiocyanate said compound is present in an amount of about 0.1 to about 20 g/l.

5. The stripping bath as defined in claim 2 in which the thiocyanate said compound is present in an amount of about 1 to about 5 g/l.

6. The stripping bath as defined in claim 2 in which the thiocyanate said compound is present in an amount of about 1 to about 2.5 g/l.

7. The stripping bath as defined in claim 2 in which said halogen compound is present in an amount up to about 12 g/l calculated as sodium bromide.

8. The stripping bath as defined in claim 2 in which said halogen compound comprises a bromine compound present in an amount of about 6 to about 10 g/l calculated as sodium bromide.

9. The stripping bath as defined in claim 2 further including a bath soluble cyanate compound in combination with said thiocyanate.

10. The stripping bath as defined in claim 9 in which said cyanate compound comprises an alkali metal cyanate salt, an ammonium cyanate salt and mixures thereof.

11. The stripping bath as defined in claim 9 in which said cyanate compound is present in an amount up to about 20 g/l.

12. The stripping bath as defined in claim 9 in which said thiocyanate is present in an amount of about 0.2 to about 0.8 g/l and said cyanate compound is present in an amount of about 2 g/l calculated as sodium cyanate.

13. The stripping bath as defined in claim 1 in which said oxalate compound is present in an amount up to its solubility in the bath.

14. The stripping bath as defined in claim 1 in which said oxalate compound is present in an amount of at least about 0.5 g/l.

15. The stripping bath as defined in claim 1 in which said oxalate compound is present in an amount of about 1 to about 4 g/l calculated as ammonium oxalate.

16. The stripping bath as defined in claim 1 in which the oxalate said compound comprises oxalic acid as well as the alkali metal and ammonium salts thereof.

17. The stripping bath as defined in claim 1 having a pH of about 5.5 to about 7.5.

18. A process for electrolytically stripping metal deposits such as copper, bright and semi-bright nickel, sulfamate nickel, nickel-phosphorous, cadmium, brass, tin, chromium and iron-nickel alloys from a different basis metal which comprises the steps of immersing an object to be stripped in a stripping bath comprising an aqueous solution having a pH of about 1 to about 14 and containing a halogen compound in an amount sufficient to activate the bath, a stripping component selected from the group consisting of (a) a bath soluble primary, secondary and/or tertiary amine having a carbon content of $C_1$ to $C_8$, (b) a bath soluble inorganic nitrate and/or organic nitro compound and mixtures of (a) and (b); an inhibiting agent present in an effective amount to inhibit attack of the basis metal comprising a compound selected from the group consisting of glucoheptonic acid, malic acid, and mixtures thereof as well as the Group IA, IIA and ammonium salts thereof; and at least one bath soluble compound selected from the group consisting of thiocyanates, oxalates, and mixtures thereof, anodically charging the object and passing electric current through the solution to a cathode for a period of time to achieve the desired magnitude of stripping of the metal deposit from the object.

19. The process as defined in claim 18 including the further step of controlling the temperature of said stripping bath within a range of about 60 to about 150° F.

20. The process as defined in claim 18 in which said bath soluble compound comprises a thiocyanate compound present in an amount of about 0.1 to about 20 g/l and including the further step of controlling the temperature of said stripping bath within a range of about 70° C. to about 100° F.

21. The process as defined in claim 20 in which said thiocyanate compound is present in an amount of about 1 to about 5 g/l.

22. The process as defined in claim 20 in which said different basis metal comprises steel and said metal deposit comprises an iron-nickel alloy or a sulfur-free nickel deposit and including the further step of controlling the electric current passing through the solution to an average current density of about 10 to about 200 ASF.

23. The process as defined in claim 18 including the further step of controlling the pH within a range of about 5.5 to about 7.5.

24. The process as defined in claim 18 in which said bath soluble compound comprises a thiocyanate compound and further including a bath soluble and compatible cyanate compound.

25. The process as defined in claim 24 in which said thiocyanate compound is present in an amount of about 0.1 up to about 20 g/l and said cyanate compound is present in an amount up to about 20 g/l.

26. The process as defined in claim 24 in which said thiocyanate compound is present in an amount of about 0.2 to about 1 g/l and said cyanate compound is present in an amount of about 1 to about 5 g/l.

27. The process as defined in claim 24 in which said thiocyanate compound is present in an amount of about 0.8 g/l calculated as ammonium thiocyanate and said cyanate compound is present in an amount of about 2 g/l calculated as sodium cyanate.

28. The process as defined in claim 18 in which said bath soluble compound comprises an oxalate compound present in an amount up to the solubility limit in said aqueous solution.

29. The process as defined in claim 28 in which said oxalate compound is present in an amount of about 1 to about 4 g/l.

30. The process as defined in claim 28 in which said halogen compound is present in an amount less than about 20 g/l calculated as sodium bromide.

31. The process as defined in claim 28 including the further step of interrupting the passing of electric current through the solution and withdrawing the object from the stripping bath and thereafter re-immersing the object in the stripping bath and again passing electric current through the solution to a cathode to achieve a further stripping of the metal deposit from the object.

32. The process as defined in claim 18 in which said bath soluble compound comprises a mixture of about 0.1 to about 20 g/l of a thiocyanate compound and about 0.5 to about 20 g/l of a cyanate compound.

* * * * *